United States Patent [19]

Stout

[11] 4,439,140

[45] Mar. 27, 1984

[54] ENERGY SAVING BOILER PURGE SEQUENCE CONTROL

[75] Inventor: Mark E. Stout, Plymouth, Minn.

[73] Assignee: Honeywell Inc., Minneapolis, Minn.

[21] Appl. No.: 362,697

[22] Filed: Mar. 29, 1982

[51] Int. Cl.[3] ..... F23N 5/20

[52] U.S. Cl. ..... 431/31; 431/3; 431/20; 431/30; 126/285.5

[58] Field of Search ..... 431/3, 6, 30, 29, 20, 431/121, 31; 236/1 G; 110/163; 126/285.5

[56] References Cited

U.S. PATENT DOCUMENTS

| | | | |
|---|---|---|---|
| 2,193,697 | 3/1940 | Roberts | 431/20 |
| 2,508,885 | 5/1950 | Mackay | 431/20 |
| 3,221,799 | 12/1965 | Hamelink et al. | 431/31 |
| 3,273,625 | 9/1966 | Holtzman et al. | 431/29 |

FOREIGN PATENT DOCUMENTS

| | | | |
|---|---|---|---|
| 56-144334 | 11/1981 | Japan | 431/29 |

*Primary Examiner*—Samuel Scott
*Assistant Examiner*—A. Flanigan
*Attorney, Agent, or Firm*—Laurence J. Marhoefer

[57] ABSTRACT

An improved boiler purge control in which purging air is forced into the boiler only after the damper is substantially in its high fire position.

2 Claims, 3 Drawing Figures

ENERGY SAVING BOILER PURGE SEQUENCE CONTROL

This invention relates to an improved method for controlling purging of gas and oil fired burners, and more particularly to a control sequence which saves energy as compared with prior art techniques.

BACKGROUND

Various standard setting bodies, such as the Underwriters Laboratory, require a preignition purge for forced and induced draft furnaces prior to lighting an interrupted or intermittent pilot. The purge sequence must assure a predetermined volume of air moves through the system—typically four air changes. One way of meeting the standards is forcing purge air through the system at a certain rate for a specified period of time; this is the method most often used because it is the easiest to implement.

For example, an acceptable purge sequence is a 30 second purge at an air flow rate equivalent to that provided at rated, high fire input to the burner. In the prior art purge sequence the blower motor is energized at substantially the same time the damper motor is energized in order to open it to its high fire position. The purge interval starts when the damper reaches a predetermined position and continues for a prescribed interval. At the end of this fixed interval, the damper is driven to its low fire position and the pilot is lit.

This prior art purge cycle is satisfactory in meeting safety standards set by the various regulatory bodies. However, for years and years those skilled in the art have failed to recognize that a substantial amount of energy is wasted during the purge cycle.

An object of this invention is to provide an improved purge method which markedly increases the efficiency of the system witout: (a) increasing the cost of the control; and (b) degrading the ability of the system to meet applicable standards.

SUMMARY OF THE INVENTION

Briefly, this invention contemplates the provision of an improved purge sequence in which the blower motor is energized at the start of the purge interval when the firing rate damper is a predetermined position.

DESCRIPTION OF THE DRAWINGS

A better understanding of the present invention may be had when the following detailed description is read in connection with the acompanying drawings, in which.

DESCRIPTION OF THE PREFERRED EMBODIMENT

Figures 1, 2:
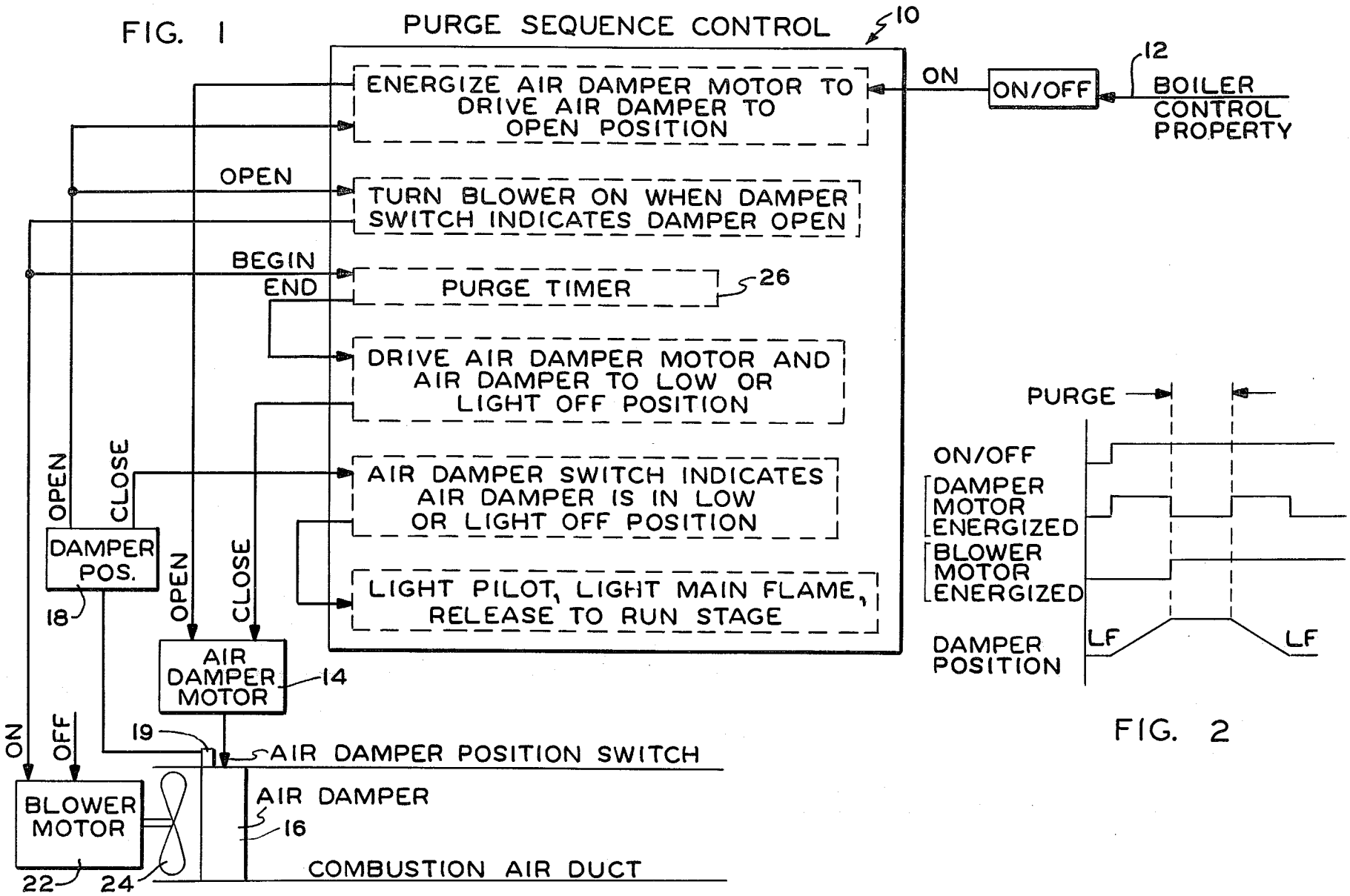
FIG. 1 is a combination of a schematic block diagram and a description of the sequence steps of one embodiment of this invention.
FIG. 2 is a diagram showing the sequence of operation for the system of FIG. 1.

Referring now to FIGS. 1 and 2, a signal on lead 12 calling for the turn-on of the boiler starts the purge sequence. The purge sequence control 10 generates an appropriate signal to energize the air damper motor driving the air damper 16 toward its open position— preferably its high fire position. It will be appreciated that all of the safety interlocks and other features of burner controls known in the prior art, and useful in the practice of this invention, have been omitted in order to clearly explain applicants invention. Further, it will be appreciated that applicants invention may be implemented in any of several technologies well known to those skilled in the art for burner control, e.g., a software programmed microprocessor; hard wired logic; and the traditional electromechanical controllers.

A sensor 18 which includes a switch or switches 19 for example, determine when the damper has reached a predetermined position at which an acceptable purge cycle can begin. In the illustrative preferred embodiment this is the high fire damper position, although a less fully open position may be suitable for some applications. At the high fire position sensor 18 generates a signal to turn off damper motor 14 and turn on air blower motor 22 coupled to the air blower motor 24. It will be appreciated that owing to the inertia of the damper a significant interval elapses between the initial energization of the damper motor and when it reaches the high-fire position. On the other hand the blower reaches speed relatively very quickly. A purge timer 26 may be activated when the blower motor is energized or shortly thereafter to allow time for the blower to reach full speed. After a fixed interval, thirty seconds for example, the purge timer generates a signal to drive the damper to its low fire or light off position, ending the purge cycle. The blower motor 22 could be turned off as damper motor 14 drives the damper to its low fire position. However, in the preferred embodiment the blower continues to operate even though the purge cycle is completed.

When the damper position sensor 18 indicates the damper is at its low fire position the pilot is lit and the remainder of the firing sequence may be the same as that in the prior art.

Figure 3:
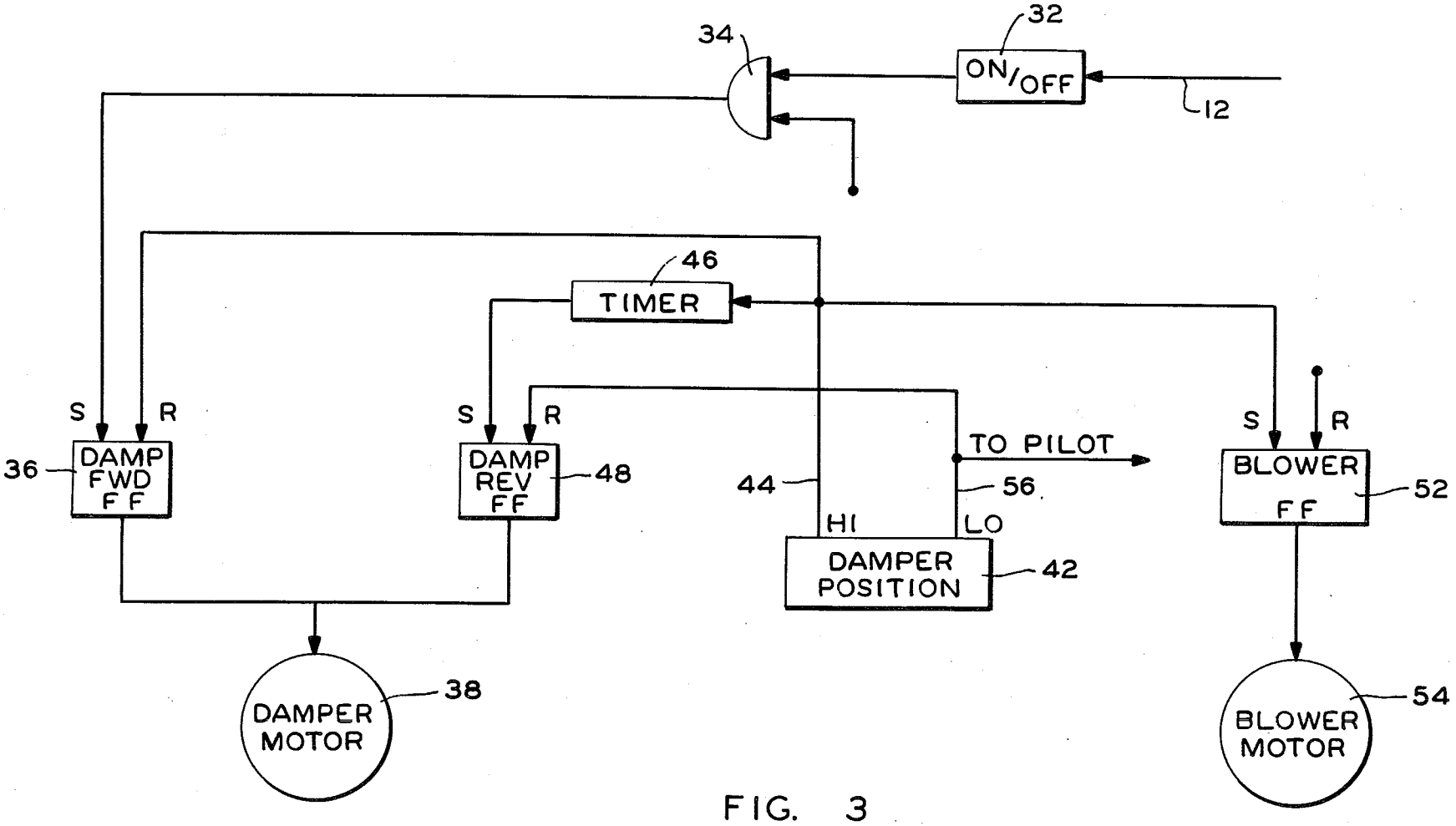
FIG. 3 is a simplified diagram of a hard wired logic system for the practice of the invention described in connection with FIGS. 1 and 2.

Referring now to FIG. 3, a signal on lead 12 calling for heat activates an on/off switch 32 whose output is coupled to one input of AND gate 34. The other input to gate 34 is coupled to a suitable interlock device known in the art. With the switch in an on condition and the interlock input in an enabling condition an output from gate 34 sets a drive damper forward flip flop 36 whose output energizes damper motor 38 to drive the motor toward its high fire position.

When the damper reaches a predetermined position such as its high fire position, for example, a damper position sensor 42 generates a signal on its high fire output 44 which resets the flip flop 36 deenergizing the damper motor 38. This output on lead 44 is also coupled as one input to a purge timer 46 whose output is coupled to the set side of a drive damper reverse flip flop 48. In operation, the timer 46 produces an output to set the flip flop 48 after a predetermined interval following the receipt of an input on lead 44 such as 30 seconds for example. At the same time, the output on lead 44 is also coupled to the set input of blower flip flop 52 whose output is coupled to energize a blower motor 54. Thus, the blower motor is energized after the damper has reached a predetermined position which is a substantial percentage of its high fire position, 100%, for example, and at the beginning of the purge interval.

As previously mentioned, after the timer 46 times out it sets the damper reverse flip flop 48 driving the damper motor toward its low fire position. When the low fire position is reached an output from damper position 42 on lead 56 resets the damper flip flop 48, and the damper motor is deenergized.

Thus, it will be appreciated that the objects of the invention have been accomplished. This novel system can markedly increase the efficiency of the overall burner system without increasing the cost of the control or degrading the ability to meet applicable safety standards.

What is claimed is:

1. An improved purge control for purging a boiler, which has a damper regulated draft, prior to lighting the boiler, comprising in combination:

means for generating a signal to move a damper to a predetermined position which is a substantial percentage of its high fire position;

means responsive to a signal indicating said damper has reached said predetermined position for generating a signal to energize a blower to create a purging draft in said boiler; and timing means responsive to a signal indicating the energization of said blower to generate a signal to move said damper toward its low fire position after a predetermined purge interval has elapsed.

2. An improved purge control for purging a boiler, which has a damper regulated draft, prior to lighting the boiler, comprising in combination:

means for generating a signal to move a damper to a high fire position;

means responsive to a signal indicating said damper has reached said high fire position for generating a signal to energize a blower to create a purging draft in said boiler; and timing means responsive to a signal indicating the energization of said blower to generate a signal to move said damper toward its low fire position after a purge interval has elapsed.

* * * * *